US006207911B1

(12) United States Patent
Hirsch et al.

(10) Patent No.: US 6,207,911 B1
(45) Date of Patent: Mar. 27, 2001

(54) COMBINED SWITCH AND DOORSTOP ASSEMBLY FOR A VEHICLE

(75) Inventors: David W. Hirsch, Columbus, OH (US); Emily Meredith, Placentia, CA (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/344,717

(22) Filed: Jun. 25, 1999

(51) Int. Cl.[7] ..... H01H 3/16

(52) U.S. Cl. ..... 200/61.81; 200/61.41; 200/61.44; 200/61.73; 200/302.2

(58) Field of Search ..... 200/61.41–61.44, 200/61.62, 61.7, 61.71, 61.73, 61.74–61.76, 61.81, 302.1, 302.2

(56) References Cited

U.S. PATENT DOCUMENTS

| | | | | |
|---|---|---|---|---|
| 3,244,829 | * | 4/1966 | Webb | 200/61.62 |
| 4,603,363 | | 7/1986 | Rickert et al. | 200/61.62 |
| 4,665,285 | | 5/1987 | Shiraishi | 360/97 |
| 4,739,133 | * | 4/1988 | Nation et al | 200/61.62 |
| 4,788,517 | * | 11/1988 | Meister | 335/205 |
| 5,167,432 | * | 12/1992 | Buttner et al. | 293/4 |
| 5,382,767 | * | 1/1995 | Takano et al. | 200/531 |
| 5,791,723 | | 8/1998 | Bell et al. | 296/155 |
| 5,836,442 | * | 11/1998 | Hirano | 200/284 |
| 5,959,271 | * | 9/1999 | Matsuhashi | 200/61.41 |

* cited by examiner

*Primary Examiner*—Michael Friedhofer
(74) *Attorney, Agent, or Firm*—Carrier, Blackman & Associates, P.C.; Joseph P. Carrier; William D. Blackman

(57) ABSTRACT

A combined doorstop and switch assembly for a vehicle includes two primary components, which are a bumper body for attaching to a vehicle body panel, and a switch which is attachable to the bumper body. The bumper body is formed of a flexibly resilient material, which may be rubber or a suitable elastomer. The bumper body has a hollow chamber formed centrally therein for receiving and holding the switch. The switch is housed within the hollow chamber of the bumper body and includes a case having a first contact disposed therein, and a push rod member slidably disposed in the case for movement therein. A spring, or other means for biasing the push rod member outwardly in the case is provided attached to the push rod member, and the switch also includes a connector for connecting to an electrical circuit, the connector being in electrical communication with the first contact. Preferrably, a flexible cap is provided, sealingly attached to the bumper body, to cover the switch and to protect it from environmental factors such as dust, dirt and moisture. Also, the bumper body and cap are combined into a single integral housing member.

22 Claims, 1 Drawing Sheet

COMBINED SWITCH AND DOORSTOP ASSEMBLY FOR A VEHICLE

BACKGROUND OF THE INVENTION

1. Field of the Invention

The present invention relates to door-activated switches and to doorstop assemblies for vehicles. More particularly, the present invention relates to a door-activated electrical switch and a door stop or motion damper for a vehicle door, combined into a single assembly.

2. Description of the Background Art

Door-activated switches, for activating an interior light, a dashboard or console indicator light, and/or an audible buzzer, are well-known and are used in substantially all vehicles. Typically, the switches are secured along a side portion of a vehicle door frame, adjacent a door hinge, and are operated by the opening and closing action of the vehicle door, alternately releasing and depressing a pushbutton activator as the vehicle door is opened and closed.

Many vehicles also conventionally use a door stop or damper, for damping or preventing further inward movement of a closing vehicle door, when it approaches or reaches a fully closed orientation thereof. Typically, such stop members are constructed of semi-rigid rubber or the like, and are either secured to the door frame, or to a free edge of a vehicle door, in a location remote from the hinge, where an edge of the door contacts the frame.

When using the previously known components, a complication could arise if an adjustment was made to set the proper extension of a stop member from a vehicle body panel, that might require separate adjustment of a door-activated switch, to compensate for the first adjustment made to the stop member.

One type of known door bumper, specifically designed for use with a sliding door on a vehicle such as a van or the like, is disclosed in U.S. Pat. No. 5,791,723 to Bell et al.

Additionally, there are known devices for providing a weather-resistant seal around a conventional door-activated switch.

U.S. Pat. No. 4,665,285 to Shiraishi, issued May 12, 1987, discloses a rubber bumper device which attaches on to an edge portion of a vehicle door, using specially designed mounting pins. The rubber bumper device of Shiraishi is adapted to be placed on an edge of a vehicle door, in a location which lines up adjacent to a conventional door switch on a vehicle body panel when the door is fully closed.

The bumper device of Shiraishi does not include a switch, but instead, pushes against a push rod of the conventional door-activated switch, when the door is closed, to switch off an interior light in the vehicle. The conventional switch, which is activated by the device of Shiraishi, is located on the vehicle body such that the switch push rod is operatively engaged by a central portion of the bumper.

A peripheral wall of the bumper which extends around an outer edge thereof, is formed of soft rubber or the like, and surrounds the conventional switch as a weather seal, when the vehicle door is closed thereagainst.

Although the known devices are effective for their intended uses, a need still exists in the art to simplify and reduce costs by combining functions of several components into fewer components, and where possible, to combine the functions of multiple components into a single assembly.

SUMMARY OF THE INVENTION

The present invention provides a combined doorstop and switch assembly for a vehicle, which may be attached to the vehicle as a single integral unit, and which may advantageously be adjusted in a single operation. In the preferred design of the assembly hereof, the switch is continuously protected against the entry of water, dirt, and other foreign matter thereinto, regardless of whether the door is open or closed.

The primary components of the combined doorstop and switch assembly, in accordance with the present invention, are a bumper body for attachment to a vehicle body panel, a switch assembly which is housed inside and secured to the bumper body for being supported thereby, and optionally, a weather-resistant cap for sealingly and protectively covering the switch.

Preferably, the bumper body is formed of a flexibly resilient and semi-rigid material appropriate for the door-stopping function thereof, such as, e.g., rubber or a suitable elastomer. A preferred material for the bumper body is an EPDM (ethylene propylene diene monomer) elastomer.

The bumper body has a hollow chamber or recess formed centrally therein, for receiving and securely holding the switch.

In a first preferred embodiment of the invention, the bumper body is formed in a barrel shape, and has a helical, external groove formed around the exterior surface thereof, for positioning the assembly in a vehicle body panel. Also in the first preferred embodiment, the bumper body has an annular interior groove formed in the interior surface thereof in communication with the hollow chamber, for retentively receiving a portion of the switch, and a peripheral external edge of the cap therein, with the cap disposed in covering relation to the switch.

In a second, alternate embodiment of the invention, the bumper body and cap are formed as an integral unit, and the switch is slidably placed thereinto from an end opposite the cap.

The switch is preferably housed within the hollow chamber of the bumper body and includes multiple components, including a case and an actuator portion housed in the case and being extensible and retractable therein. The actuator portion is preferably provided by a push rod member slidably disposed in the case for movement therein, with a spring, or other means for biasing an outer end of the push rod member outwardly from the case, also making up part of the switch. The switch also includes a first contact disposed in the case, a second contact disposed in the case and spaced apart from the first contact, means for electrically connecting the first and second contacts, and an electrical coupling in electrical communication with the first and second contacts.

As previously noted, in the preferred embodiment of the present invention, the assembly includes a flexibly resilient weather-resistant cap or cover means for protectively covering the switch. The cap is provided for resisting the entry of water, dirt and other impurities into the switch. The outer peripheral edge of the cap may fit sealingly into the interior annular groove of the bumper body. Alternatively, the cap and bumper body may be made as a single integral switch housing member.

Accordingly, it is an object of the present invention to provide an apparatus for attaching to a vehicle body to provide both a doorstop and a switch in a single assembly.

It is a further object of the present invention to provide a combined switch and door stop which is protected from water, dirt and other foreign matter.

It is yet a further object of the present invention to provide a combined switch and door stop which is adjustably attachable to a vehicle body panel.

It is an advantage of the present invention that during the process of assembling a vehicle, the single component accessory hereof can be installed more quickly, and less expensively, than the two components which it replaces.

It is another advantage of the present invention that the depth of the door stopper, and the operative position of the door-activated switch, may be adjusted together in a single operation, and when the door stopper is set to the correct depth with respect to the body, the switch is also automatically placed at the correct extension thereof.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PRESENTLY PREFERRED EMBODIMENTS

Figure 1:
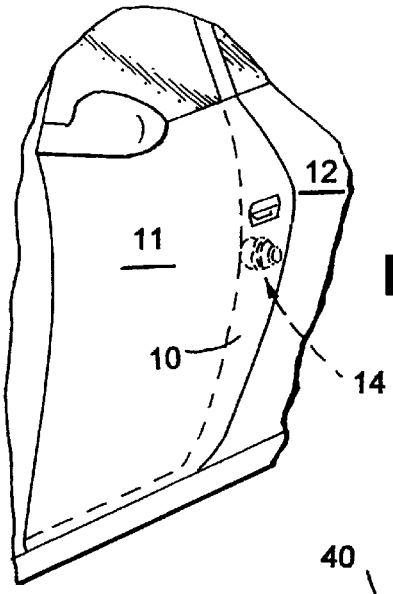
FIG. 1 is an environmental perspective view of a door portion of a car body, shown partially cut away, with a combined door stop and switch assembly shown in phantom, installed therein.

Referring now to FIG. 1 of the drawings, a door frame portion 10 of a vehicle body 12 is shown with a closed door 11 in place therein. A combined doorstop and switch assembly 14, according to the present invention, is shown in phantom behind the door 11, mounted in the door frame 10. The vehicle door 11 is shown with an edge thereof pressing against the assembly 14 according to the invention.

Overview of the First Preferred Embodiment

A combined doorstop and switch assembly 14, in accordance with a first embodiment of the present invention, includes a bumper body 16 (FIG. 2) for attaching to a vehicle body panel 10, and a switch 18 which is housed inside, and is integrally secured to the bumper body 16. A protective cap or cover member 15 is optionally provided secured to the bumper body 16 and covering the switch 18. Each of these components of the assembly 14 will be discussed in further detail below.

The Bumper Body

The bumper body 16 is formed of a resilient yet semi-rigid material, which may be rubber or a durable elastomer. A preferred material for the bumper body is an EPDM (ethylene propylene diene monomer) elastomer. The bumper body 16 is of a strength and thickness sufficient to make it durable enough to serve as a door stop, or energy absorbing damper, when in place in a vehicle.

The door stop function of the bumper body 16 provides a shock absorbing effect, to soften a closing movement of a door 11 and to minimize vibration traveling through the frame 10 from the mechanical contact of the door therewith.

Figure 2:
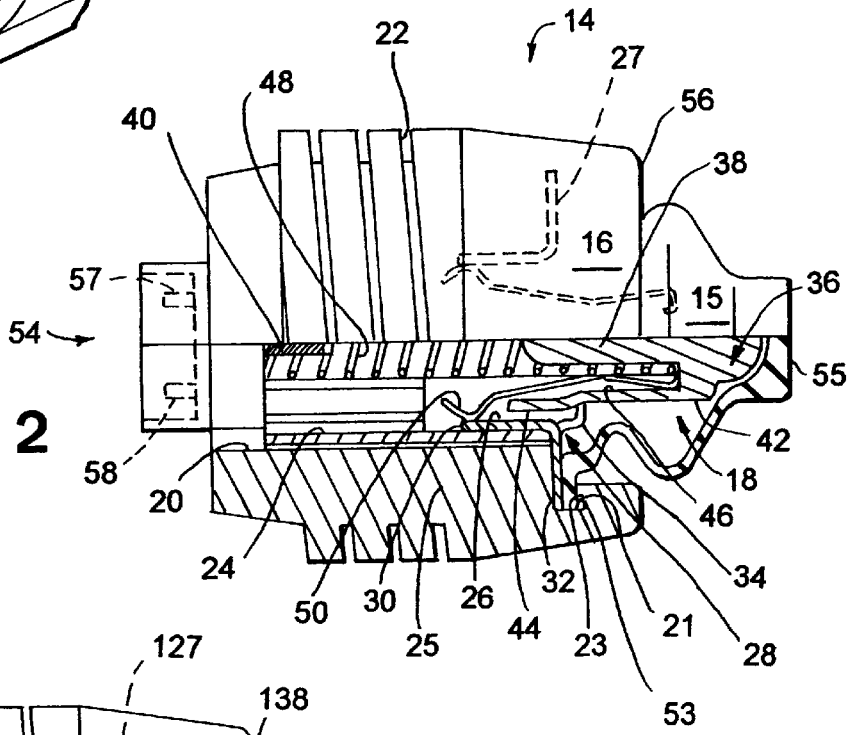
FIG. 2 is a side plan view, partially in cross-section, of a first preferred embodiment of the combined door stop and switch assembly in accordance with the present invention, with selected internal components thereof shown in phantom.

For convenience in discussing the assembly hereof, the part of the bumper body shown on the left in the illustration of FIG. 2, will be referred to as the inner part thereof, since that portion will be installed inside a vehicle body. Correspondingly, the right part of the bumper body, as shown in FIG. 2 of the drawings, will be referred to throughout the present specification as the outer part, since this part faces outwardly in the installed configuration of the assembly 14.

Preferably, the bumper body 16 is formed in a substantially cylindrical or barrel shape, and may have an external helical groove 22 formed as a spiral around the exterior surface thereof, as shown. Where used, the groove 22 is provided to allow the assembly 14 to be threadably and rotatably installed into a circular hole in a vehicle body panel, such as the door frame or jamb 10. The provision of the external helical groove 22, on the exterior surface of the bumper body 16, also provides the further advantage of allowing for easy depth adjustment of the assembly 14 in the door jamb 10 after installation, and also, advantageously, allows for simultaneous adjustment of the door stop and switch functions of the assembly 14.

The bumper body 16 has a recess or hollow chamber 20 formed centrally therein for receiving and holding the switch 18. In the embodiment of FIG. 2, the hollow chamber 20 passes entirely through the bumper body to form a substantially cylindrical passage therethrough.

An internal annular groove 21 may, optionally, also be provided inside the interior of the bumper body, as shown, to receive and retentively hold the switch 18 therein, and to also receive an outer peripheral edge of the cover member therein, allowing it to protectively and sealingly cover the switch. In a particularly preferred embodiment of the invention, the bumper body 16 includes a retaining bead 23 which extends inwardly into the annular groove 21, as shown.

Preferably, the bumper body 16 has a thickened center section 25 adjacent the internal groove, to provide added strength and stability thereto.

The Switch

As previously indicated, the switch 18 fits inside the hollow chamber 20 of the bumper body 16. The switch 18 is shaped to conform to the shape of the chamber 20, and includes a hollow case 24, which acts as a housing for other parts of the switch. The case 24 is formed of a non-conductive plastic, and is housed within the hollow chamber 20 of the bumper body 16, as shown. The case 24 is preferred to include a centrally located, integrally cast anchor pin 40 on the floor thereof, as shown.

The switch 18 has a first contact 26 disposed in the case 24, which is affixed thereto by gluing, by a rivet, or by any other suitable fixed connection. In the preferred embodiment, the first contact 26 is provided by a metal bracket 28. In the depicted embodiment, the metal bracket 28 includes a first flat section 30, a transverse flange 32 which is integrally formed with the first flat section and which extends therefrom at substantially a right angle, and an inwardly projecting collar 34 attached to the top of the first flat section. However, the inwardly projecting collar need not be electrically conductive, and may be formed as a separate piece from the bracket, out of a separate material, so long as it is fixedly attached thereto. The transverse flange 32 of the metal bracket 28 fits into the internal annular groove, as shown, and helps to retain the switch 18 in place inside the bumper body 16. As an equivalent alternative to the use of the transverse flange 32 on the bracket, instead, the case 24 may include an integrally formed right-angle collar (not shown).

The switch also includes a second contact 27 disposed in the case 24 and spaced apart from the first contact 26. It is necessary that the second contact 27 be situated farther inside the bumper body 16 than the first contact 26, so that the contacts stay out of communication with one another until a bridge spring 50 is at the outer extension of its travel in the case 24.

The switch 18 also includes at least one, and preferably two connectors 57, 58 in the plug end 54 of the case 24, for connecting to an electrical circuit. Suitable wires, metal tape, or other conventional electrical connection means are provided attached to the first and second contacts 26, 27, respectively, and the respective electrical connectors are also connected to the respective connectors 57, 58 at the plug end 54 of the case 24.

The switch 18 also includes an actuator portion for extending outwardly from the outer end of the bumper body 16 and for operatively engaging an edge of a vehicle door 11. The actuator portion may be provided by an outer end of a push rod member 36, which is slidably centrally disposed in the case 24 for movement therein. The push rod member 36 is preferably formed from a strong plastic material. In the depicted embodiment, the push rod member 36 includes a center post 38 extending inwardly into the case, opposite the central anchor pin 40 in the case 24. The push rod member 36 also includes a hollow sleeve 42 which surrounds the center post 38 and which is spaced apart therefrom.

The sleeve 42 and the center post 38 define a substantially cylindrical hollow space 46 therebetween. A coil spring 48 is placed inside the switch 18, between the push rod member 36 and the anchor pin 40. Opposed ends of the coil spring 48 surround the center post 38 and the anchor pin 40, respectively, and accordingly, the coil spring 48, when compressed in the housing, exerts an outward biasing force on the push rod member 36.

The innermost part of the sleeve 42 flares outwardly to form an expanded diameter portion 44. The expanded diameter portion 44 of the push rod member 36 acts as a stop member to retain the push rod member below the inwardly projecting collar 34 of the metal bracket 28, since the collar 34 substantially surrounds the push rod member 36, and since the expanded diameter portion of the push rod member is too large to pass therethrough.

The switch 18 also includes a metallic bridge spring 50 which is disposed within the substantially cylindrical hollow space 46, external to the coil spring 48. The metallic bridge spring 50 acts to bridge the distance between the first contact 26 and the second contact 27, when the push rod member 36 is at the outermost extent of its travel, in the position shown in FIG. 2. When the bridge spring interconnects the first and second contacts 26, 27, electrical continuity is provided therebetween.

When the assembly 18 is plugged into an electrical circuit, and the door 11 is opened, the coil spring 48 pushes the push rod member 36 outwardly from the case until the bridge spring interconnects the first and second contacts 26, 27. At that point, the circuit is completed and electrical power flows therethrough to perform work, such as, for example, to light an interior dome lamp and illuminate the passenger compartment of a vehicle.

The Cover Member

Also in the preferred embodiment of the present invention, a flexible, water-resistant cap or cover member 15 is provided to cover and protect the switch 18. The cover member 15, where used, may be made of rubber or a suitable elastomer which may be the same as, or different than, the material used for the bumper body 16. The cover member 15, according to the most preferred embodiment of the invention, has a raised peripheral ridge 53 extending continuously around the outer edge thereof, for sealing placement behind the retaining bead 23 of the bumper body. The tip end 55 of the cover member 15 is made thicker than the remainder thereof, to provide an extended wear surface for contacting an edge of the vehicle door 11.

Overview of the Second Preferred Embodiment

Figure 3:
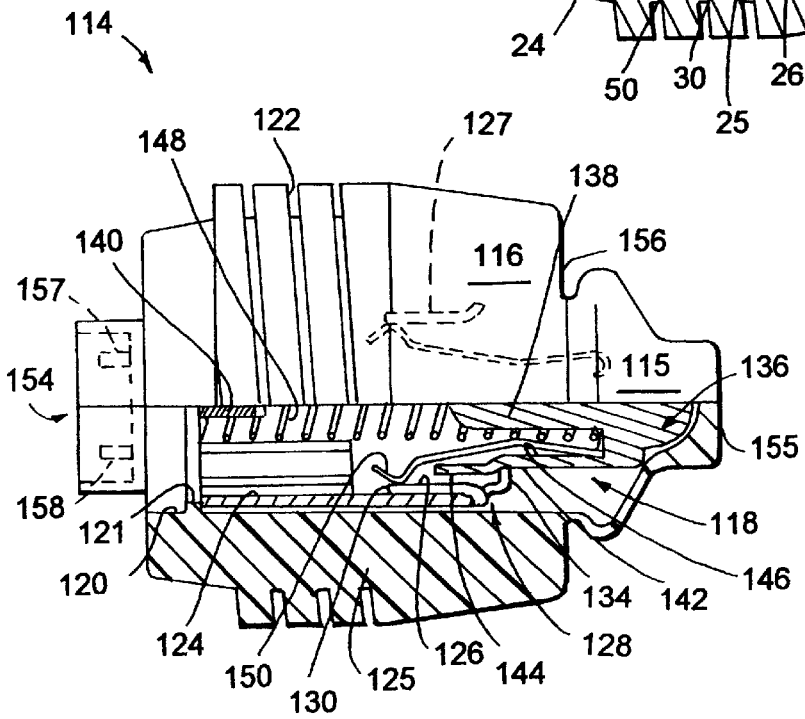
FIG. 3 is a side plan view, partially in cross-section, of a second preferred embodiment of the combined door stop and switch assembly in accordance with the present invention, with selected internal components thereof shown in phantom.

Referring now to FIG. 3, a combined doorstop and switch assembly 114, in accordance with a second preferred embodiment of the present invention, includes a housing member 116 for attaching to a vehicle body panel 10, and a switch 118 which is housed within, and integrally secured to the housing member 116. The housing member 116, in this embodiment, combines the functions of the previously discussed bumper body 16 and protective cap or cover member 15 into a single, integrally molded part. Each of these components of the assembly 114 will be discussed in further detail below.

The Housing Member

The housing member 116 is formed of a resilient yet semi-rigid material, which may be rubber or a durable elastomer. A preferred material for the housing member is an EPDM (ethylene propylene diene monomer) elastomer. The housing member 116 is of a strength and thickness sufficient to make it durable enough to serve as a door stop, or energy absorbing damper, when in place in a vehicle. Preferably, the housing member 116 has a thickened center section 125 below the internal groove, to provide added strength and stability thereto.

Preferably, the main body of the housing member 116 is formed in a substantially cylindrical or barrel shape, and may have an external helical groove 122 formed as a spiral formed around the exterior surface thereof, as shown. Where used, the groove 122 is provided to allow the assembly 114 to be threadably and rotatably installed into a circular hole in a vehicle body panel, such as the door frame or jamb 10. The provision of the external helical groove 122, on the exterior surface of the housing member 116, also provides the further advantage of allowing for easy depth adjustment of the assembly 114 in the doorjamb 10 after installation.

The housing member 116 has a recess or hollow chamber 120 formed centrally therein, for receiving and holding the switch 118. In the embodiment of FIG. 3, the hollow chamber 120 passes only part of the way through the housing member to form a substantially cylindrical recess therein.

The switch 118 is pressed into the chamber 120 from the interior side of the housing member 116. The housing preferably has a raised ridge 121 formed on the interior thereof to retain the switch 118 within the chamber 120.

In the embodiment of FIG. 3, the housing member 116 further includes a flexible, water-resistant cap or cover member 115 to cover and protect the switch 118. The cover member 115 is integrally formed with the main body of the housing member 116. The cover member 115 is made of rubber or a suitable elastomer which may be the same as, or different than, the material used for the housing member 116. The tip end 155 of the cover member 115 is made thicker than the remainder thereof, to provide an extended wear surface for contacting an edge of the vehicle door 11.

The Switch

As previously indicated, the switch 118 fits inside the hollow chamber 120 of the housing member 116. The switch 118 functions substantially similarly to the previously described switch 18. The switch 118 is shaped to conform to the shape of the chamber 120, and includes a hollow case 124, which houses other parts of the switch. The case 124 is formed of a non-conductive plastic. The case 124 is preferred to include a centrally located, integrally cast anchor pin 140 on the floor thereof, as shown.

The switch 118 has a first contact 126 disposed in the case 124, which is affixed thereto by gluing, by a rivet, or by any other suitable fixed connection. In the preferred embodiment, the first contact 126 is provided by a metal bracket 128. In the embodiment of FIG. 3, the metal bracket 128 includes a first flat section 130 and an inwardly projecting collar 134 attached to the top of the first flat section. However, the inwardly projecting collar 134 need not be electrically conductive, and may be formed as a separate piece from the bracket 128, out of a separate material, so long as it is fixedly attached thereto.

The switch also includes a second contact 127 disposed in the case 124 and spaced apart from the first contact 126. It is necessary that the second contact 127 be situated farther inside the housing member 116 than the first contact 126, so that the contacts stay out of communication with one another until a bridge spring 150 is at the outer extension of its travel in the case 124.

The switch 118 also includes at least one, and preferably two connector plugs 157, 158 in the plug end 154 of the case 124, for connecting to an electrical circuit. Suitable wires, metal tape, or other conventional electrical connection means are provided attached to the first and second contacts 126, 127, respectively, and the respective electrical connection means are also connected to the respective connector plugs 157, 158 at the plug end 154 of the case 124.

The switch 118 also includes an actuator portion for extending outwardly from the outer end of the housing member 116 and for operatively pressing an outermost tip 155 of the cover 115 against an edge of a vehicle door 11. The actuator portion may be provided by an outer end of a push rod member 136, which is slidably centrally disposed in the case 124 for movement therein. The push rod member 136 is preferably formed from a strong plastic material. In the embodiment, the push rod member 136 includes a center post 138 extending inwardly into the case, opposite the central anchor pin 140 in the case 124. The push rod member 136 also includes a hollow sleeve 142 which surrounds the center post 138 and which is spaced apart therefrom.

The sleeve 142 and the center post 138 define a hollow space 146 therebetween. A coil spring 148 is placed inside the switch 118, between the push rod member 136 and the anchor pin 140. Opposed ends of the coil spring 148 surround the center post 138 and the anchor pin 140, respectively, and accordingly, the coil spring 148, when compressed in the housing, exerts an outward biasing force on the push rod member 136.

The innermost part of the sleeve 142 flares outwardly to form an expanded diameter portion 144. The expanded diameter portion 144 of the push rod member 136 acts as a stop member to retain the push rod member below the inwardly projecting collar 134 of the metal bracket 128, since the collar 134 substantially surrounds the push rod member 136, and since the expanded diameter portion 144 of the push rod sleeve 142 is too large to pass therethrough.

The switch 118 also includes a metallic bridge spring 150 which is disposed within the hollow space 146, external to the coil spring 148. The metallic bridge spring 150 acts to bridge the distance between the first contact 126 and the second contact 127, when the push rod member 136 is at the outermost extent of its travel, in the position shown in FIG. 3.

When the bridge spring 150 interconnects the first and second contacts 126, 127, electrical continuity is provided therebetween.

When the switch 118 is plugged into an electrical circuit, and the door 11 is opened, the coil spring 148 pushes the push rod member 136 outwardly from the case 124 until the bridge spring 150 interconnects the first and second contacts 126, 127. At that point, the circuit is completed and electrical power flows therethrough to perform work, such as, for example, to light an interior dome lamp and illuminate the passenger compartment of a vehicle.

Use of the Assembly

The use of the assembly will be described in relation to the embodiment of FIG. 2. When the apparatus 14 according to the invention is installed in a vehicle, and a vehicle door (not shown) is closed thereagainst, two things happen. First, the door presses the push rod member 18 inwardly into the case against the force of the spring 48. This moves the bridge spring 50 away from the first contact 26 to open the circuit, most preferably to shut off the vehicle interior lamp (not shown).

Secondly, when the outer end of the push rod member 18 is pressed into the case 24 beyond a certain point, the leading edge of the door comes in contact with the outer edge 56 of the bumper body 16. The bumper body 16 compresses somewhat to absorb and dampen the force of the closing door.

The combined assembly 14 according to the present invention provides the added advantage that the depth of the door stopper bumper body 16, and the operative position of the door-activated switch 18, may be simultaneously adjusted in a single operation, by spinning the assembly 14 in place in a vehicle body panel until the bumper body 16 is correctly oriented to function as a door motion damper. When the bumper body is adjusted to the correct depth in the body panel, the switch is advantageously set to the correct orientation thereof, without requiring a separate adjustment as was previously necessary with separate doorstop and switch devices. Using the embodiment of FIG. 3 is substantially identical to using the first embodiment as herein described.

Although the present invention has been described herein with respect to a preferred embodiment thereof, the foregoing description is intended to be illustrative, and not restrictive. Those skilled in the art will realize that many modifications of the preferred embodiment could be made which would be operable.

One possible modification is that the cover member 15 could be deleted and instead, a large resilient rubber button (not shown) could be attached directly to the outermost end of the push rod member, to further combine the functions of the assembly. Another possible modification is to make the bumper body box-shaped, instead of cylindrical.

All such modifications, which are within the scope of the appended claims, are intended to be within the scope and spirit of the present invention.

We claim:

1. A combination door stop and switch assembly, comprising:

stopper means for attaching to a body portion of a vehicle and for damping movement of a door of the vehicle toward the body portion; and switch means attached to said stopper means, said switch means including an actuator portion movable inwardly with respect to said stopper means such that said stopper means also limits movement of the door relative to said switch means.

2. The combined door stop and switch assembly of claim 1, further comprising cover means attached to said stopper means for covering said actuator portion, and for resisting entry of water and dirt into said switch means.

3. The assembly of claim 2, wherein:

said cover means comprises a flexibly resilient cap having an outer edge with a peripheral ridge thereon; and said recess of said stopper means has an internal groove formed therein with a retaining ridge formed at an edge of said groove, said outer edge of said cap fitting retentively and engagingly in said internal groove with said peripheral ridge retentively held by said retaining ridge.

4. The assembly of claim 2, wherein said stopper means is formed of EPDM elastomer.

5. The combined door stop and switch assembly of claim 2, wherein said stopper means and said cover means are formed separately of different materials.

6. The combined door stop and switch assembly of claim 2, wherein said stopper means and said cover means are formed integrally as a unitary member of a single material.

7. The combined door stop and switch assembly of claim 1, wherein said stopper means comprises a semi-rigid, resilient member having a recess defined therein, wherein said switch means is secured within said recess of said stopper means, and wherein said actuator portion of said switch means is movable into said recess.

8. The combined door stop and switch assembly of claim 7, wherein said switch means includes electrical coupling means extending through said stopper means for extending into said vehicle body portion.

9. The combined door stop and switch assembly of claim 1, wherein said switch means comprises a case having an inner end and an outer end with a transverse flange extending outwardly thereon to engage in said stopper means.

10. The assembly of claim 1, further comprising depth adjustment means for simultaneously adjusting a relative depth of each of said stopper means and said switch means with respect to the vehicle body portion.

11. The assembly of claim 10, wherein said stopper means has a substantially cylindrical exterior shape, and wherein said depth adjustment means comprises a helical external groove extending spirally therearound to allow said stopper means to be rotatably and threadably inserted into a circular hole formed in the vehicle body portion.

12. The assembly of claim 1, wherein said stopper means is formed of EPDM elastomer.

13. A combined doorstop and switch assembly for a vehicle, comprising:

a bumper body for attaching to a vehicle body panel, said bumper body being formed of a flexibly resilient material and having a hollow chamber formed therein;

a switch housed within the hollow chamber of the bumper body, said switch comprising a case, electrical contacts, a push rod member slidably disposed in said case for selectively connecting and disconnecting the electrical contacts, and biasing means for urging one end of said push rod member outwardly from said case and said hollow chamber; and said bumper body including means for adjustably connecting the bumper body to the vehicle body panel such that an extent to which the bumper body projects from the panel may be selectively varied.

14. The combined door stop and switch assembly of claim 13, further comprising cover means attached to said bumper body for covering said one end of said push rod member, and for resisting entry of water and dirt into said switch.

15. The assembly of claim 13, wherein said bumper body has a substantially cylindrical exterior shape, and said connecting means includes a helical external groove extending spirally therearound to allow the bumper body to be rotatably and threadably inserted into a circular hole formed in a vehicle body panel.

16. The assembly of claim 13, further comprising cover means for protectively covering said switch and for resisting the passage of water therepast.

17. The assembly of claim 16, wherein:

said cover means comprises a flexibly resilient cap having an outer edge with a peripheral ridge thereon; and said hollow chamber of said stopper means has an internal groove formed therein with a retaining ridge formed at an edge of said groove, said outer edge of said cap fitting retentively and engagingly in said internal groove with said peripheral ridge retentively holdable by said retaining ridge.

18. The assembly of claim 13, wherein said bumper body is formed from EPDM elastomer.

19. The combined door stop and switch assembly of claim 13, wherein said bumper body and said cover means are formed separately of different materials.

20. A combined doorstop and switch assembly for a vehicle, comprising:

a bumper body for attaching to a vehicle body panel, said bumper body being formed of a flexibly resilient material and having a hollow chamber formed therein;

a switch housed within the hollow chamber of the bumper body, said switch comprising a case, electrical contacts, a push rod member slidably disposed in said case for selectively connecting and disconnecting the electrical contacts, and biasing means for urging one end of said push rod member outwardly from said case and said hollow chamber;

said bumper body has a substantially cylindrical exterior shape, and has a helical external groove extending spirally therearound to allow the bumper body to be rotatably and threadably inserted into a circular hole formed in a vehicle body panel; and a flexibly resilient cap for protectively covering said switch and for resisting the passage of water therepast.

21. The assembly of claim 20, wherein:

said flexibly resilient cap has an outer edge with a peripheral ridge thereon; and said hollow chamber of said bumper body has an internal groove formed therein with a retaining ridge formed at an edge of said groove;

and wherein said outer edge of said cap fits retentively and engagingly in said internal groove of said bumper body, with said peripheral ridge of said cap being retentively holdable by said retaining ridge.

22. The assembly of claim 20, wherein said bumper body is formed from EPDM elastomer.

* * * * *

UNITED STATES PATENT AND TRADEMARK OFFICE

CERTIFICATE OF CORRECTION

PATENT NO. : 6,207,911 B1
DATED : March 27, 2001
INVENTOR(S) : David W. Hirsch, Emily k. Meredith It is certified that error appears in the above-identified patent and that said Letters Patent is hereby corrected as shown below:

Title page,
Under "[75] Inventors", change "Emily Meredith" to -- Emily K. Meredith --, in accordance with the official filing receipt.

Signed and Sealed this

Twenty-third Day of October, 2001

*Attest:*

Nicholas P. Godici

NICHOLAS P. GODICI

*Attesting Officer*

*Acting Director of the United States Patent and Trademark Office*